United States Patent [19]

Yukawa et al.

[11] Patent Number: 4,616,161

[45] Date of Patent: Oct. 7, 1986

[54] CURRENT DEPENDENT TYPE COLOR CATHODE RAY TUBE

[75] Inventors: Takahiro Yukawa, Tokyo; Hideo Kusama, Yokohama; Koji Kanbayashi, Tomisato; Osamu Takeuchi, Hino, all of Japan

[73] Assignee: Sony Corporation, Tokyo, Japan

[21] Appl. No.: 542,478

[22] Filed: Oct. 17, 1983

[30] Foreign Application Priority Data

Oct. 19, 1982 [JP] Japan ..... 57-183173

[51] Int. Cl.[4] ..... H01J 29/58

[52] U.S. Cl. ..... 315/382; 315/370

[58] Field of Search ..... 315/14, 15, 382, 374; 313/444, 449; 358/66, 72, 73, 74

[56] References Cited

U.S. PATENT DOCUMENTS

| | | | |
|---|---|---|---|
| 3,651,359 | 3/1972 | Miyaoka | 315/15 |
| 3,949,166 | 4/1976 | Fuse | 315/382 |
| 4,390,896 | 6/1983 | Ploumen | 358/73 |
| 4,453,179 | 6/1984 | Peters et al. | 358/72 |

OTHER PUBLICATIONS

J. C. Greeson, Multicolor Variable Intensity Display, IBM Tech. Disclosure Bulletin vol. 12, No. 12, May 1970.

*Primary Examiner*—Theodore M. Blum

*Attorney, Agent, or Firm*—Hill, Van Santen, Steadman & Simpson

[57] ABSTRACT

An improved current dependent type color cathode ray tube which utilizes a color phosphor screen which has at least two phosphors that have current density versus brightness characteristics which differ from each other and which emit light of different colors and including an electron gun which emits an electron beam which impinges on the color phosphor screen and wherein the current density of the electron beam of the gun varies in response to color signals so as to cause the emission of the desired colors to produce a color image and wherein the focusing voltage of the electron gun is varied so that the just focussing state occurs at the highest drive current within the drive current range and the focal length associated with the focussing voltage at the just focussing state is displaced by more than 5% from the focal length represented by the lowest drive current.

7 Claims, 9 Drawing Figures

CURRENT DEPENDENT TYPE COLOR CATHODE RAY TUBE

BACKGROUND OF THE INVENTION

1. Field of the Invention

The invention relates in general to color cathode ray tubes and more particularly to a color cathode ray tube of the current dependent type.

2. Description of the Prior Art

Color cathode ray tubes used in general color television receivers utilize an electron beam which passes through a shadow mask, an aperture grill or similar structure which is located adjacent a phosphor screen so that the electron beams corresponding to the respective colors impinge on the phosphor dots or stripes of the respective colors formed on the color phosphor screen so as to produce a color image.

Color cathode ray tubes of the so-called current dependent type are known which have no electron beam landing position determining means. For these tubes, the color phosphor screen is formed by mixing and coating phosphors of at least two colors which have luminance characteristics versus current density which are different from each other. Thus, when the electron beam current density from the common electron beam source changes or in practice the cathode current value is varied, the light emission of a predetermined hue is obtained.

Since current dependent type color cathode ray tubes include no electron beam aligning and blanking means, the cathode ray tube can be light weight and the manufacturing and assembling processes can be very simple. There is also a further advantage in that the resolution can be improved and color misregistration caused by the relative position displacement between the phosphor screen and the electron beam landing position determining means are avoided, since there are no electron beam landing position determining means in such tubes.

The characteristics of the electron gun in the practical color cathode ray tube are such that correspondence between the cathode current and the current density is not linear so sufficiently high color purity cannot be obtained with such prior art cathode ray tubes.

The copending patent application entitled "Current Sensitive Color Cathode Ray Tube" filed June 7, 1982 Ser. No. 385,831 assigned to the assignee of the present invention discloses a current dependent color type cathode ray tube in which the color phosphor screen is formed of phosphor whose luminance or brightness characteristics versus current density is a so-called sub-linear characteristic as illustrated by curve 1 in the graph of FIG. 1 and which emits red light. The phosphor having a so-called super-linear characteristic shown by curve 2 in the graph to FIG. 1 emits green light and the above two different phosphors are mixed together and laminated one on the other. The current density of the electron beam which strikes the color phosphor screen and which is varied by the cathode current is switchable to selected values shown by A, B and C in the graph of FIG. 1. When the current density is selected to have a value A, the light emission of the red color determined by the characteristic 1 at a point a is dominantly made. When the current density is selected to have the value B, the light emission determined by the intersection of the characteristics 1 and 2 at a point b will occur which is the light emission of yellow as an intermediate color between red and green occurs. When the current density is selected to have the value C, although the light emission determined by the characteristic 2 at point c is made dominantly the light emission of yellowish green caused by the light emission by the characteristic 1 is obtained. Thus, when the beam current density is selectively changed in response to a color signal, a color image can be reproduced on the color phosphor screen.

The current density is changed by changing the cathode current. However, in practice, when the cathode current Ik is changed, the spot diameter of the beam formed on the phosphor screen is also changed. The relationship between the cathode current Ik and the spot diameter of the beam is illustrated by curve 3 in the graph of FIG. 2 in which as the cathode current Ik increases, the spot diameter of the beam also increases. This relationship is not linear so that the relationship between the cathode current Ik and the current density at the beam spot will not be linear as is illustrated in curve 4 in the graph of FIG. 3. Thus, if the value of the cathode current Ik is varied within the range from a value D to a value E illustrated in FIG. 3, the current density is changed in a relatively small range from a value F to a value G. Thus, in this case, the cathode current Ik is selected to have a value of E and the current density C shown in the graph of FIG. 1 will be obtained. If the cathode current is selected to be the lower limit value D, the current density cannot be made small enough to satisfactorily operate. The current density cannot take a value so as to produce the red light emission shown in the graph of FIG. 1, and hence the color purity particularly the red color purity for this example, is lowered.

SUMMARY OF THE INVENTION

It is an object of the present invention to provide an improved color cathode ray tube having a color phosphor screen made of respective color phosphor having more than two brightness characteristics which can eliminate the defects inherent in conventional color cathode ray tubes of the prior art.

Another object of the present invention is to provide a current dependent type color cathode ray tube which improves color purity.

It is a further object of the present invention to provide a current dependent type color cathode ray tube which produces an image having a superior quality picture.

Yet another object of the present invention is to provide a current dependent type color cathode ray tube which is suitable for use with a color television receiver.

According to one aspect of the present invention, there is provided a current dependent type color cathode ray tube comprising a color phosphor screen formed of at least two phosphors having current density versus brightness characteristics which differ from each other and which emit lights of different color and an electron gun which emits an electron beam which impinges on the color phosphor screen and the current density of the electron beam is changed in response to color signals to generate necessary color output and to thereby produce a color image and wherein the focussing voltage in the electron gun is varied such that a focussing state which is at the edge of the focussed condition occurs at the highest drive current within a drive current range in which light emissions of the respective colors are obtained by the electron beam and a focal length resulting from said focussing voltage during the focussing state is displaced by more than 5% from a focal length utilized when a lowest drive current occurs.

Other objects, features and advantages of the present invention will become apparent from the following description of certain preferred embodiments thereof taken in conjunction with the accompanying drawings although variations and modifications may be effected without departing from the spirit and scope of the novel concepts of the disclosure, and in which:

DESCRIPTION OF THE PREFERRED EMBODIMENTS

Figure 2:
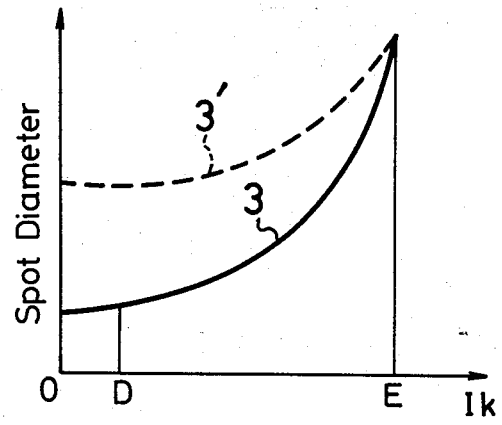
FIG. 2 is a graph showing the relationship between the cathode current and spot diameter in a color cathode ray tube.
Figure 3:
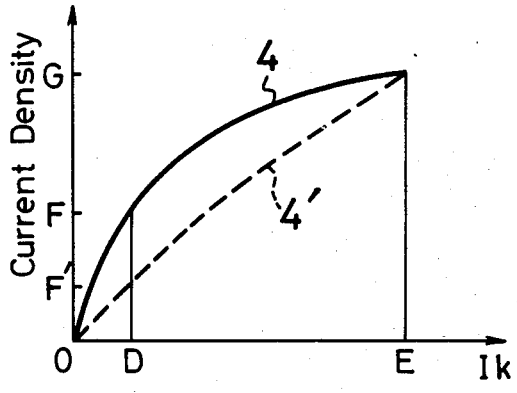
FIG. 3 is a graph showing the relationship between the cathode current and the current density.

The present invention improves the color purity by obtaining the sufficient change of the current density within the change range of the cathode current illustrated on lines D to E in FIG. 3. As shown by a broken line 4' in the graph of FIG. 3, the cathode current Ik versus current density characteristic is as linear as possible and is established with a current density change in a range from F' to G which is wider than the current density change in the range from F to G obtained in the same range of the cathode current change from D to E. For this purpose, particularly the cathode current Ik versus the spot diameter characteristic is made to be flat as shown by the broken line curve 3' in the graph of FIG. 2.

So that a larger spot diameter may be obtained in the low region of the cathode current Ik while a smaller spot diameter is obtained in the higher region of the cathode current Ik if the main electron lens system consists of, for example, a unipotential type of electron gun, it may be considered that the diameters of the first and second grids G1 and G2 through which the electron beam passes are made larger and further that the focussing voltage is selectively changed in response to the value of the cathode current Ik. However, when the focussing voltage is adjusted in response to the cathode current, the sensitivity becomes low and designing of the circuit becomes inconvenient and there is a difficult problem relative to the frequency characteristic.

Figure 1:
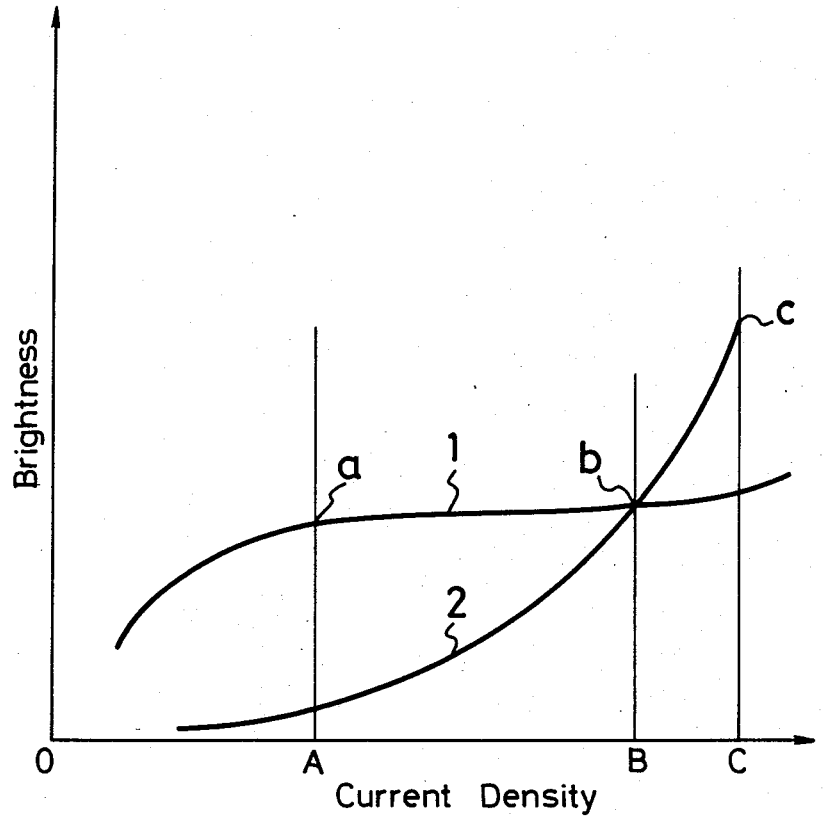
FIG. 1 is a graph illustrating the relationship between current density and brightness characteristics of a color cathode ray tube.

According to the invention, the cathode current Ik versus focussing voltage characteristic of the electron gun in the current dependent type color cathode ray tube is selected so as to have a particular characteristic which is different from that utilized in the prior art. In the electron gun of the conventional cathode ray tube, the focussing voltage is determined so as to enable the optimum focussing to be always established over the whole change range of the cathode current. For example, as shown by curve 5 in the graph of FIG. 4, the prior art gun is designed so that the cathode current Ik versus optimum focussing voltage characteristic or focussing tracking characteristic is flat. On the other hand, according to the present invention, as is shown by the curves 6 and 7 in the graph of FIG. 4, the focussing tracking characteristic is selected so that it rises up to the right or falls down to the right and the focussing voltage is determined in a manner such that a under focussed state is presented at the highest drive current of the cathode current Ik which is the cathode current value C illustrated, for example, in FIG. 1. Then the focal length determined by this focussing voltage is displaced by more than 5% from the focal length established by the appropriate focussing voltage at the lowest drive current of the cathode current. This is the value A for example, illustrated in FIG. 1 so that a weak focus or so-called underfocussing state or an excessive focus or so-called over focussing state exists at the value A. According to the present invention, the defocussing state is positively made in the small current region of the cathode current Ik and hence the spot diameter is made to be larger at the small current region so that the characteristic shown by the broken line curve 3' in the graph of FIG. 2 is obtained and then the cathode current Ik versus current density characteristic illustrated by the broken line curve 4' in the graph of FIG. 3 is obtained, thus increasing the difference between the current density F' obtained by the minimum drive current by D of the cathode current and the current density G obtained at the maximum drive current value E.

Figure 5:
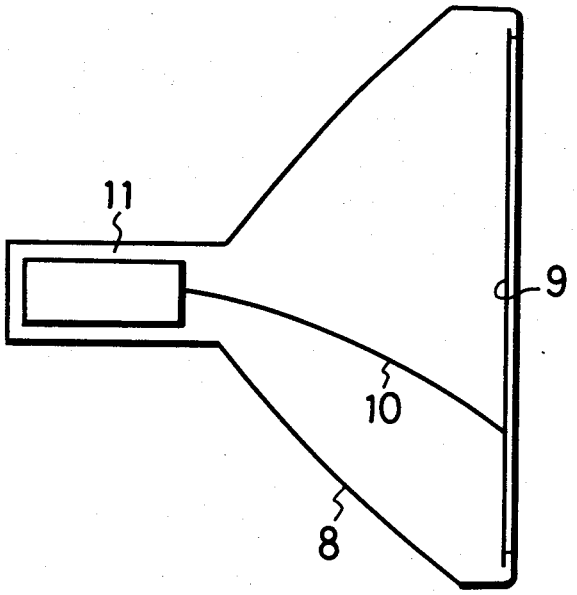
FIG. 5 is a schematic diagram of an embodiment of the current dependent type color cathode ray tube according to the present invention.

The present invention is illustrated in FIG. 5 which illustrates a cathode ray tube envelope 8 which has a phosphor color screen 9 formed on the inner surface of the panel. The screen 9 is formed by mixing or laminating red phosphor having the so-called sublinear characteristic illustrated by FIG. 1 curve 1 and the green phosphor having the so-called superlinear characteristic illustrated by curve 2 in FIG. 1.

An electron gun 11 is mounted in the envelope 8 in the neck as shown and emits an electron beam 10 which impinges upon the color phosphor screen 9.

Figure 6:
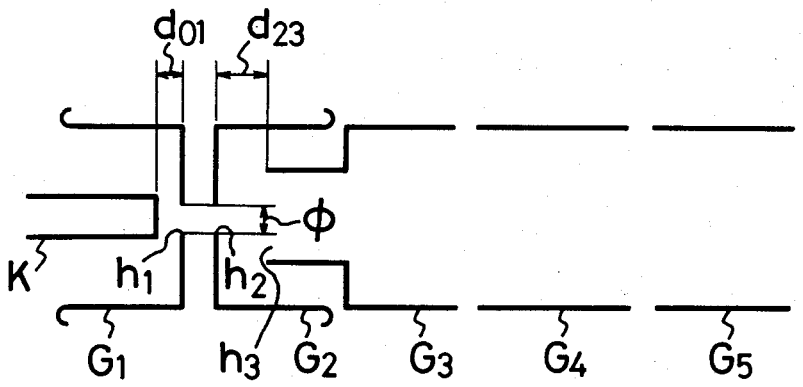
FIG. 6 is a diagram showing an example of the electron gun used in the current dependent type color cathode ray tube illustrated in FIG. 5.

As illustrated in FIG. 6, the electron gun 11 includes a cathode K which emits electrons which pass through a first grid control electrode G1 and then to a second grid acceleration electrode G2 and then to a third grid first anode G3 then through the fourth grid focussing electrode G4 and a fifth grid second anode G5 all of which are coaxially arranged as illustrated. In a particular example, the third grid G3, the fourth grid G4 and the fifth grid G5 constitute the main electron lens, for example, a unipotential lens or bipotential lens and in this particular example comprise a unipotential lens.

In response to color signals of, for example, red R, yellow Y and yellowish green G, the cathode current Ik takes values of IkR, IkY and IkG. In a particular example, IkR=50 μA, IkY=370 μA and IkG=700 μA respectively.

The voltage which is applied to the focussing electrode Ec4 to the fourth grid G4 is set so that the just focussing state occurs at the maximum drive current value IkG=700 μA. The underfocussing state occurs at the minimum drive current value of IkR=50 μA. As is stated in other words, the focussing voltage Ec4 applied to the fourth grid G4 is selected so that the cathode current Ik versus focussing voltage characteristic (focussing tracking characteristic) illustrated by the characteristic curve 6 in the graph of FIG. 4 is established.

Figure 7:
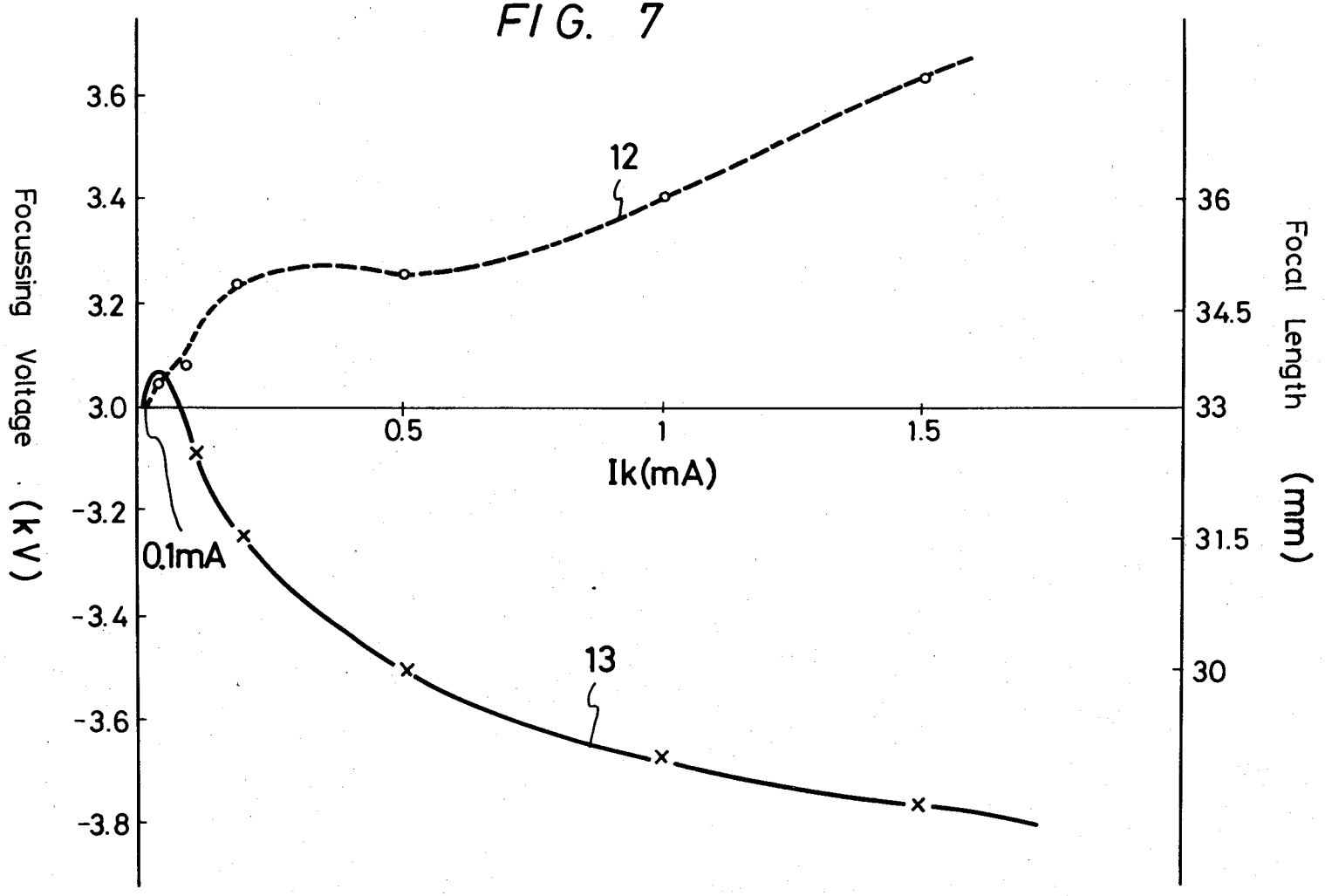
FIG. 7 is a graph showing the relationship between the focal length and the focussing voltage relative to the cathode current.

In a specific example, the thickness of the first grid G1 is selected to be 0.2 mm and the inner diameters $\phi$ of the beam through-holes $h_1$ and $h_2$ of the first and second grids G1 and G2 are respectively selected to be 0.8 mm and the spacing $d_{01}$ between the cathode K and the beam through-hole $h_1$ of the first grid G1 is selected to be 0.31 mm and the spacing $d_{23}$ between the beam through-holes $h_2$ and $h_3$ of the second and third grids G2 and G3 is selected to be 2.8 mm. For these parameters, the tracking characteristic is as shown by the broken line curve 12 in the graph of FIG. 7. In FIG. 7, on the origin Z of the ordinate occurs on the optimum focussing voltage 3 kV when the current Ik=10 μA. When the spacing $d_{01}$=0.1 mm and $d_{23}$=7.8 mm, the tracking characteristic illustrated by the solid line curve 13 in FIG. 7 was obtained. In this case, when the tracking characteristic is determined as the characteristic 12 the underfocussing state occurs at the minimum drive current value IkR and the tracking characteristic is determined by the characteristic 13 when the overfocussing state is presented at the minimum drive current value IkR. In this case, in the color cathode ray tube having the conventional configuration which provides flat tracking characteristic, the spacing $d_{01}$ is selected to be 0.2 mm and the spacing $d_{23}$ is selected to be 6.3 mm. The right axis on the graph of FIG. 7 indicates the focal length in millimeters. In this case, both the curves 12 and 13 allow the change of the focal length of more than 5% within the current range. As determined above, according to the present invention, since the focussing tracking characteristic is determined so as to provide the approximately barely or just focussing state at the maximum drive current IkG and the defocussing state at the minimum drive current IkR at the maximum drive current IkG a relatively small spot diameter can be obtained while at a smaller drive current particularly the minimum drive current of IkR although the spot diameter becomes small inherently the defocussing state is positively obtained. As a result, the reduction of the spot diameter is small and thereby the current density can be sufficiently small.

Figure 8:
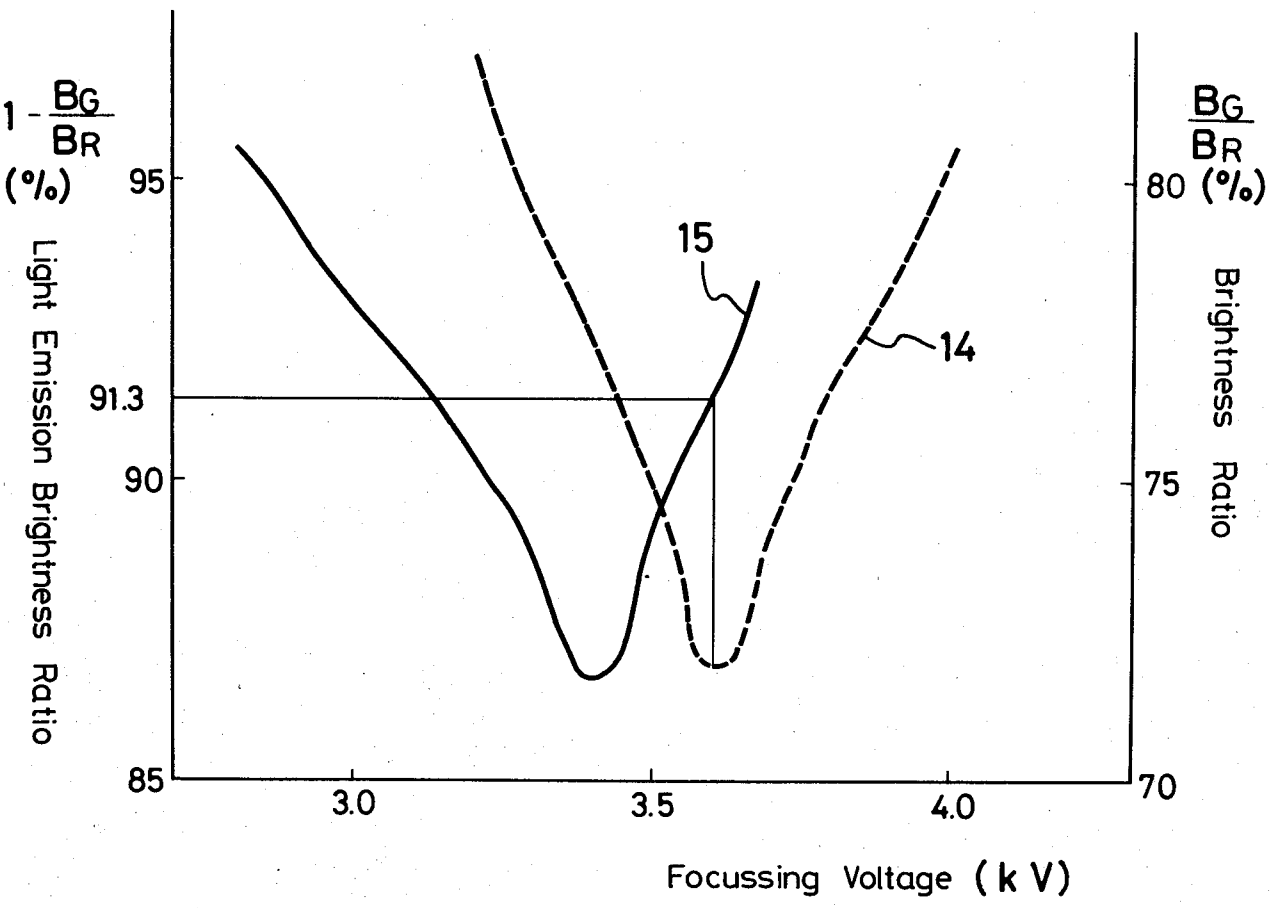
FIG. 8 is a graph showing a brightness ratio characteristic.
Figure 9:
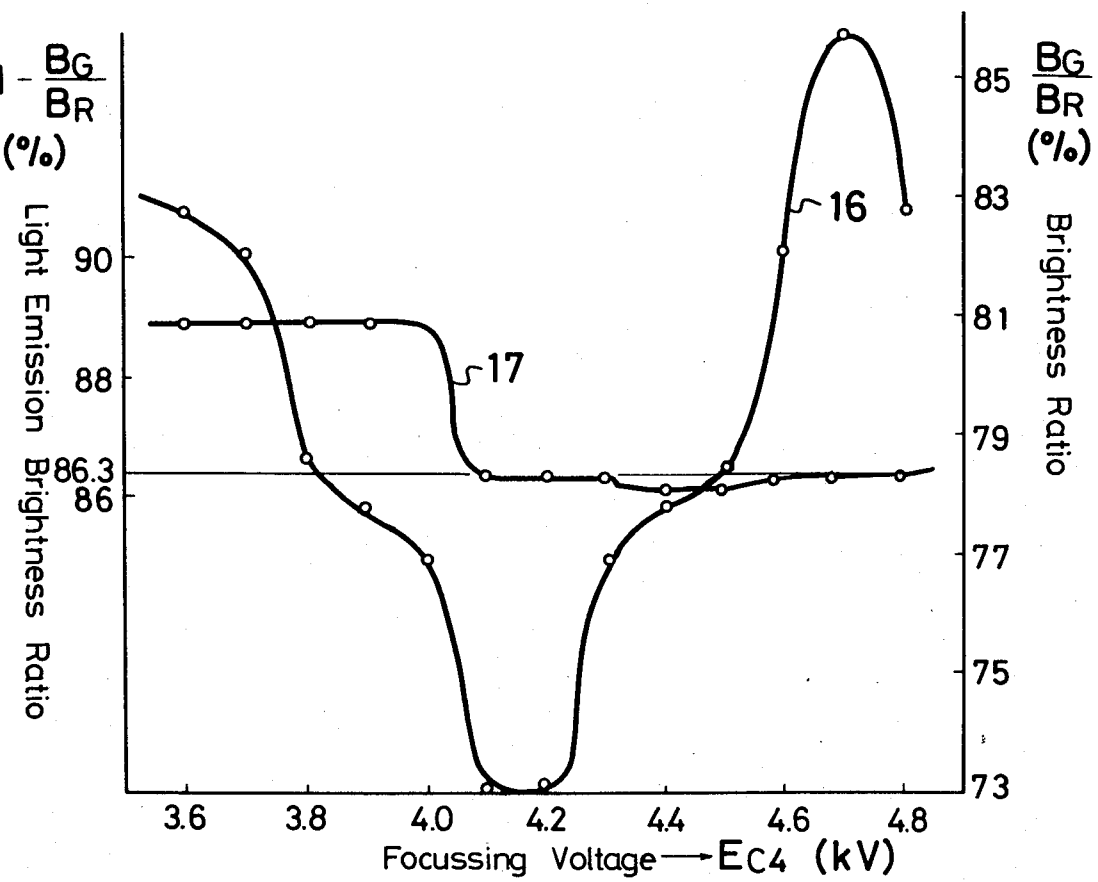
FIG. 9 is a graph showing a conventional brightness ratio characteristic.

FIG. 8 is a graph illustrating the light emission brightness ratio (percentage) relative to the focussing voltage Ec4 measured when the characteristic 12 illustrated in FIG. 7 is selected which rises up on the right hand side. As illustrated in the graph of FIG. 8, the broken line curve 14 indicates the brightness ratio BG/BR (percentage) between the yellowish green light emission brightness BG and the red light emission brightness BR wherein the maximum drive current IkG=700 μA and the solid line curve 15 indicates the light emission brightness ratio 1−(BG/BR) percentage in which the drive current is selected to be the minimum drive current IkR. For this case, the anode voltage was selected to be 24 kV the voltage Ec2 applied to the second grid G2 was selected to be 43 V and the cut-off voltage was selected to be 55 V respectively. For these conditions the focussing voltage Ec4 to establish the substantially just or barely focussing state under the condition when Ik=700 μA will be 3.6 kV. Then if the focussing voltage Ec4 to be applied to the fourth grid G4 is determined as 3.6 kV at the minimum drive current IkR=50 μA the light emission brightness ratio shown by the intersection with the solid line curve 15, 1−(BG/BR) percentage equals 91.3 percentage is established. The similar brightness ratio characteristic of the conventional configuration having flat focussing tracking characteristic is illustrated in FIG. 9. In FIG. 9, a curve 16 indicates the light emission brightness ratio BG/BR in which the maximum drive current IkG=700 μA and a curve 17 indicates the light emission brightness ratio, 1−(BG/BR) percentage in which the minimum drive current IkR=50 μA. For this case, the focussing voltage Ec4 at the just focussing state on the curve 16 will be approximately 4.15 kV. Then if the focussing voltage Ec4 is determined as 4.15 kV, the curve 17 indicates that the brightness ratio at which the minimum drive current IkR=50 μA will have a value which is as low as 86.3%.

Figure 4:
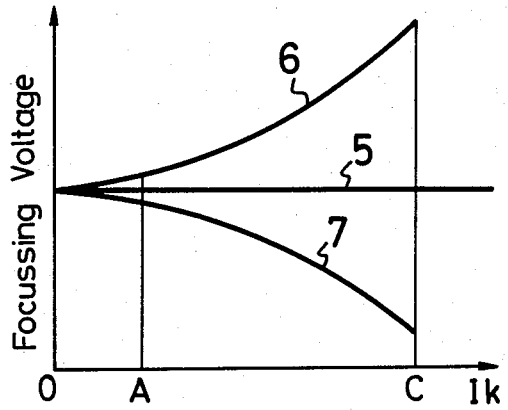
FIG. 4 is a graph showing the focussing tracking characteristic of the color cathode ray tube.

When the defocusing state occurs at the minimum drive current IkR, it is possible that the focussing tracking characteristic could be set so as to be the characteristic 6 or 12 which rises up to the right as illustrated in FIGS. 4 or 7 or the characteristics 7 or 13 which falls down to the right. For this case, at the focussing tracking characteristic as set as the characteristic which rises up to the right, which is the underfocussing state the electron density of the beam spot can be uniform. Then there is an advantage that bright spots having uniform light emission color can be obtained where if the focusing tracking characteristic is set so that the characteristic turns down to the right, the overfocussing state is established and the depth of focus is large and this is advantageous for a case such that a dynamic focus correcting voltage is superimposed upon the DC focussing voltage Ec4.

As described, according to the current dependent type color cathode ray tube of the present invention, even when light emission of, for example, red is generated at the minimum drive current, IkR it can have a high brightness ratio and the color purity can be improved over tubes of the prior art. A color image having a superior picture quality can also be obtained.

It is to be realized, of course, that the biasing sources for the grids G1 through G5 provide the suitable bias voltages so as to obtain the advantages of the invention. Furthermore, the spacings of the various grids and apertures as illustrated in FIG. 6 are selected so as to obtain the advantages of the invention.

Although a single preferred embodiment of the invention is described, it will be apparent that many modifications and variations may be effected by one skilled in the art without departing from the spirit and scope of the novel concepts of the invention and the scope of the invention should be determined only by the appended claims.

We claim as our invention:

1. A current dependent type color cathode ray tube comprising; a color phosphor screen formed of at least two phosphors which overlay each other having current density versus brightness characteristics which are different from each other and which emit light energy of different colors; an electron gun emitting an electron beam which impinges on said color phosphor screen, means for changing the current density of said electron beam in response to color signals to generate light energy of different colors to thereby produce a color image, wherein the focussing voltage for said electron gun is set to be a voltage such that a focussed state occurs at the highest drive current within a drive current range in which light emissions of respective colors are obtained by said electron beam and the focal length which occurs with said focussing voltage at said focussed state is displaced by more than 5% from the focal length obtained at the lowest drive current.

2. A method of operating a current dependent cathode ray tube which has a color phosphor screen formed of different phosphors which overlay each other which have different current versus brightness characteristic and emit light energy of different colors, comprising the steps of, emitting an electron beam from an electron gun which impinges on said phosphor screen, changing the current density of said electron beam, setting the focussing voltage of said electron gun at a level such that a focussed state exists at the highest drive current and the focal length which occurs at said focussed state is displaced by more than 5% from the focal length which occurs at the lowest drive current.

3. A current dependent type color cathode ray tube according to claim 1 comprising a cathode in said electron gun, and means receiving a color video signal connected to said cathode to vary the drive current of said cathode ray tube.

4. A current dependent type color cathode ray tube according to claim 3 including a focusing grid in said tube, and means supplying a voltage to said focussing grid so that the beam is focussed on said screen at the highest drive current.

5. A current dependent type color cathode ray tube according to claim 4 wherein the focal length which occurs at said focussed state is displaced by more than 5% from the focal length obtained at the lowest drive current.

6. A current dependent type color cathode ray tube according to claim 1 wherein said lowest drive current occurs when the color red is produced.

7. A current dependent type color cathode ray tube according to claim 1 wherein said highest drive current occurs when the color yellowish green is produced.

* * * * *